United States Patent [19]

Andersson

[11] Patent Number: 4,478,156

[45] Date of Patent: Oct. 23, 1984

[54] NESTABLE LOAD CARRIER

[75] Inventor: Kjell Andersson, Löddeköpinge, Sweden

[73] Assignee: Alfa-Laval AB, Tumba, Sweden

[21] Appl. No.: 390,854

[22] Filed: Jun. 22, 1982

[30] Foreign Application Priority Data

Jun. 23, 1981 [SE] Sweden ..... 8103945

[51] Int. Cl.[3] ..... B65D 21/02

[52] U.S. Cl. ..... 108/53.1; 108/53.3; 108/55.3; 206/507; 206/509; 206/511

[58] Field of Search ..... 206/509, 505, 507, 511, 206/512; 108/53.1, 53.3, 53.5, 55.1, 55.3

[56] References Cited

U.S. PATENT DOCUMENTS

| | | | |
|---|---|---|---|
| 1,757,618 | 5/1930 | Clark | 206/509 |
| 3,636,888 | 1/1972 | Angelbeck, Jr. | 108/53.1 |
| 3,848,546 | 11/1974 | Lawlor | 108/55.3 X |
| 3,995,749 | 12/1976 | Haskins | 108/53.1 X |
| 4,093,070 | 6/1978 | Stahl | 206/507 |
| 4,106,624 | 8/1978 | Thurman | 206/507 |

FOREIGN PATENT DOCUMENTS

| | | | |
|---|---|---|---|
| 7506512 | 12/1975 | Netherlands | 206/511 |

*Primary Examiner*—William E. Lyddane

*Assistant Examiner*—James R. Brittain

*Attorney, Agent, or Firm*—Cyrus S. Hapgood

[57] ABSTRACT

A stackable load carrier for transporting and furnishing objects comprises an open-top box-like member which has a side wall and a bottom from which there extends downwardly a frame having, on the one hand, two opposed similar open recesses extending from the lower edge surface of the frame substantially up to the bottom and adapted to permit the insertion of at least one fork of a hand-lift truck or the load-carrying part of a sack trolley underneath the bottom, and, on the other, two opposed similar windows laterally spaced apart from the recesses and arranged to permit the insertion of at least one fork of a fork-lift truck or the load-carrying part of a sack trolley underneath the bottom. One or more shoulders or projections disposed on the outer side of the side wall or the frame above or on a level with the upper edge of the windows are arranged for abutting engagement with the lower frame edge surface of another load carrier telescopically stacked on the first load carrier. The load carrier is preferably square and the distance between the shoulder and the upper edge of the side wall preferably is, at the most, equal to the distance between the lower edge of the windows and the lower edge of the frame.

8 Claims, 3 Drawing Figures

NESTABLE LOAD CARRIER

Figure 1:
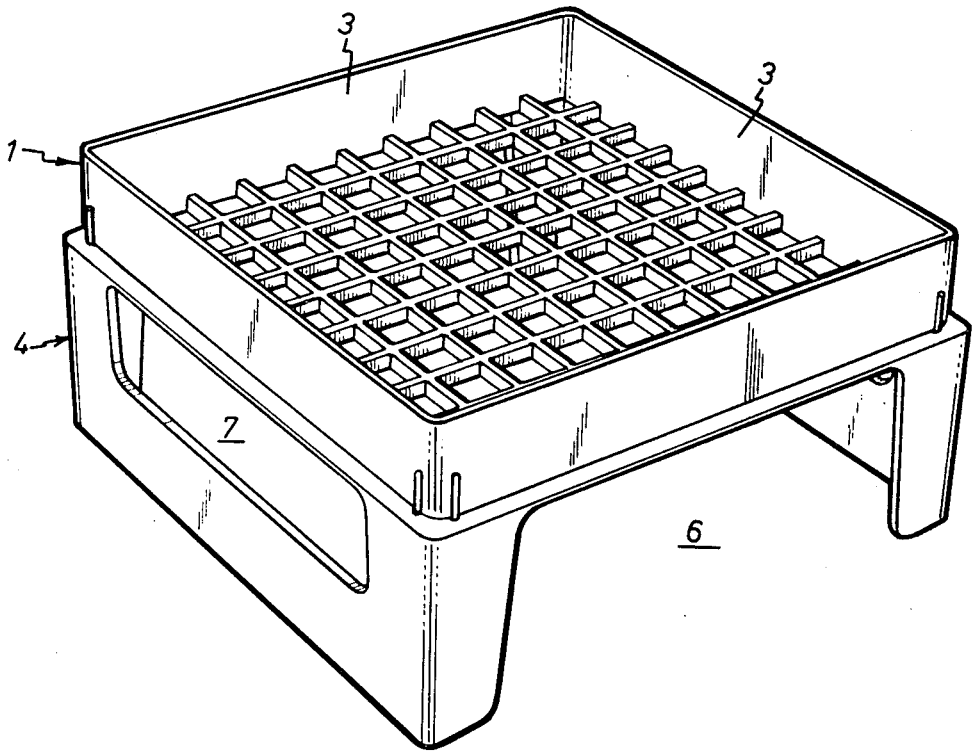

The present invention relates to a load carrier comprising an open-top box member with a bottom and side walls, for transporting and furnishing objects which are placed on said bottom.

Prior-art load carriers suffer from various drawbacks. They are either designed as pallets with or without lateral walls and do not permit stable stacking in both the vertical and the lateral direction, or are designed as crates or platforms which when stacked cannot be transported, for instance by means of hand-lift trucks, without the use of pallets on which the stack can rest. Moreover, prior-art load carriers of the crate type most often do not allow proper exposure of the objects carried thereon, which will then have to be removed from the crates to be placed on a site of exhibition, for instance a shelf. A drawback of load carriers provided with legs is that they do not permit transporting the load carrier on a roller conveyor.

The object of the present invention is to overcome the above-mentioned shortcomings inherent in prior-art load carriers. According to the invention, this is achieved by the provision of a load carrier having a frame which is connected to and extends downwardly from the bottom and comprises, on the one hand, two similar opposed recesses which extend from the lower edge surface of the frame substantially up to the bottom and which are so dimensioned as to allow the insertion therein of at least one fork of a hand-lift truck or the load supporting means of a sack trolley underneath said bottom, and, on the other, two similar opposed windows which are laterally spaced apart from said recesses and are so dimensioned as to allow the insertion therein of at least one fork of a fork-lift truck or the load supporting means of a sack trolley underneath said bottom, first shoulder means being disposed on the outer wall of the load carrier above or on a level with the upper edges of the windows, and the inner circumference of the frame being greater than the outer circumference of the side walls, at least through a height from the lower edge of the frame which corresponds to the distance between the shoulder means and the upper edge of the side walls, said shoulder means serving as an abutment for lower frame edge surface portions of a telescopically received load carrier.

The load carrier according to the invention can be manufactured in different heights and yet be stackable. The lower edge surface portions of the frame located below the windows serve as runners which permit transporting the load carrier or a stack thereof on a roller conveyor. Single load carriers or stacks thereof can be handled directly from different directions by means of fork-lift trucks, hand trucks, sack trolleys and the like, without the need of conventional pallets. The recesses and windows allow excellent exposure of the goods carried. The high frame enables high objects placed in a subjacent load carrier in a stack to laterally, stably support the superjacent part of the stack.

Figure 2:
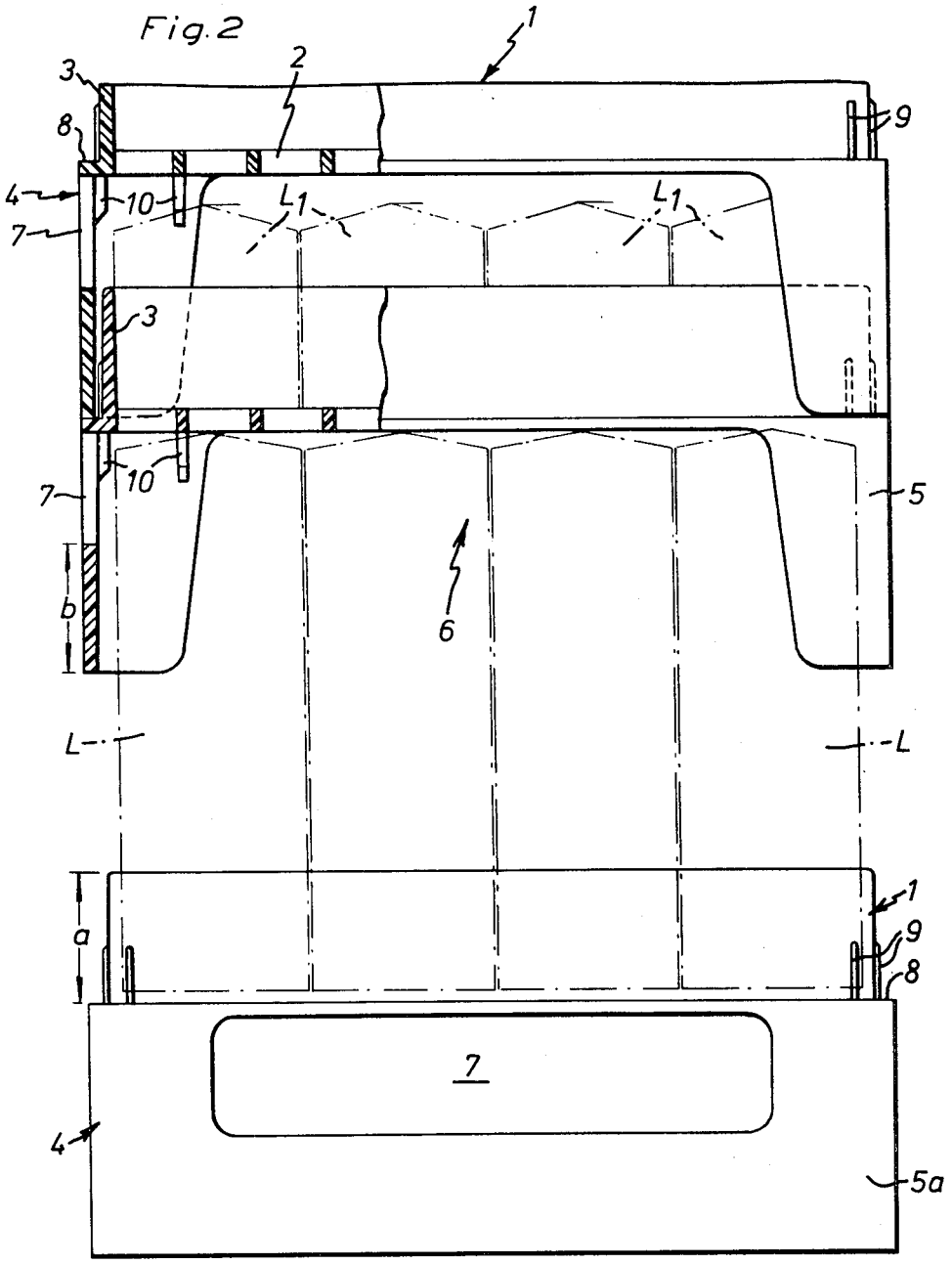

The invention will be described in greater detail hereinbelow with reference to the accompanying drawings, in which:

FIG. 1 shows a platform-like load carrier according to the invention;

FIG. 2 in section, shows a stack of load carriers according to FIG. 1; and

Figure 3:
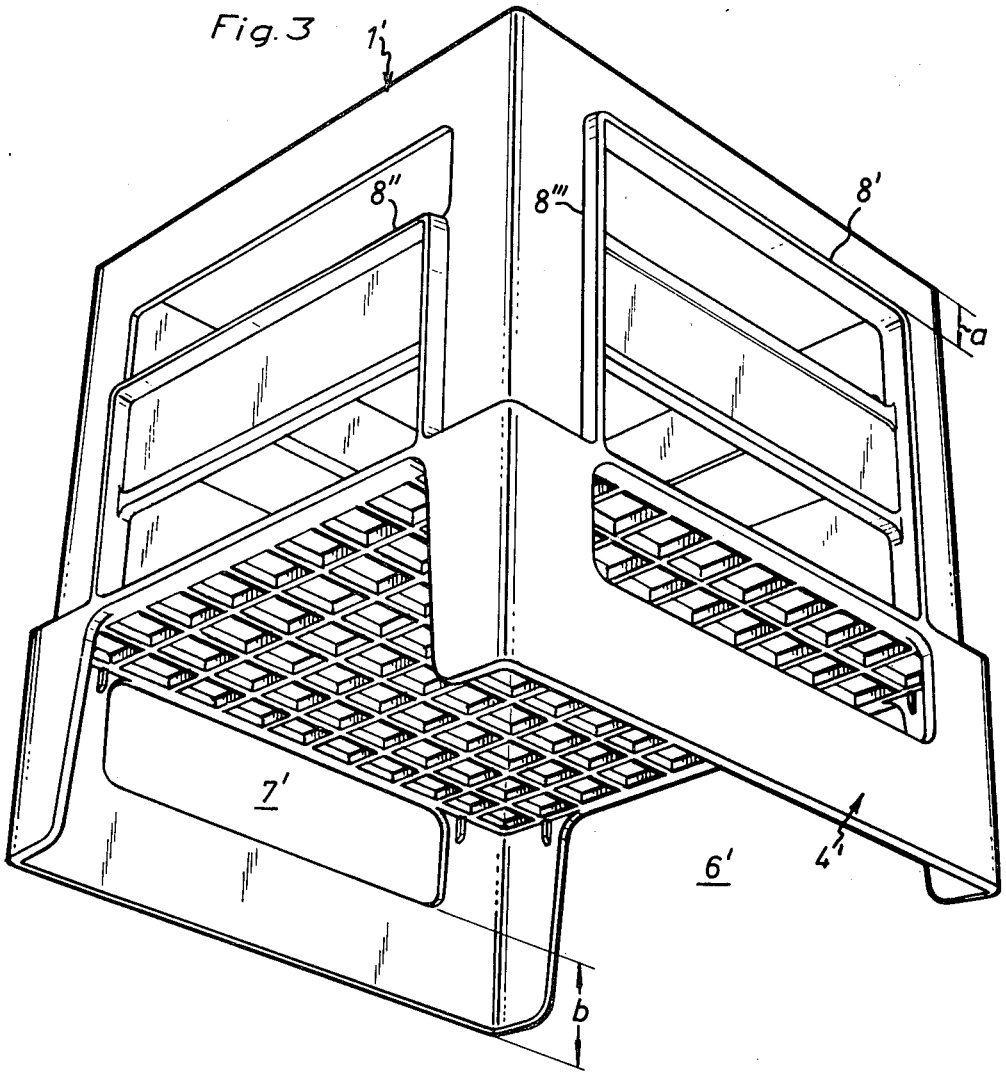

FIG. 3 modified crate-type load carrier.

As illustrated in FIGS. 1 and 2, the load carrier which is manufactured by injection moulding of plastic has a box member 1 of square cross-section which is open at the top and has a perforated bottom 2 and side walls 3. From the periphery of the bottom 2 there extends downwardly a frame 4 of substantial height and of square profile. In the central portions of two opposed frame side walls 5, there is a recess or port 6 extending from the lower edge surface of the side wall 5, preferably up to the bottom 2. The recesses 6 are facing each other and are of equal design, and their dimensions are such that they allow the insertion of one fork of a wheel-supported hand-lift truck or of the load-carrying part of a sack trolley underneath the bottom 2 of the box member 1. The fork is entered through one recess 6 and may be passed out through the opposite recess. With conventional fork trucks for handling pallets, a suitable height of the recess and the frame is about 90 mm. A suitable width of the recess at the bottom 2 is about 310 mm. In each of the other two opposed side walls 5*a* of the frame 4, there is a central rectangular window 7. The windows are facing each other and are of equal design, and their upper edges are preferably defined by the undersurface of the bottom 2. The dimensions of the windows 7 are such that one cantilever fork of a fork-lift truck or the load-carrying part of a sack trolley can be inserted underneath the bottom 2 through any one of the windows 7. The fork is entered through one window 7 and may be passed out through the opposite window. With current fork-lift trucks, a suitable window height is about 45 mm and a suitable window width about 310 mm.

A circumferential shoulder 8 which is parallel to the lower edge surface of the frame 4 is provided at the outer sides of the box side walls and serves as an abutment for the free edge surface of the frame 4 of another, stacked load carrier of identical design. Stacking is made possible in that the inner peripheral line of the frame 4, at least throughout a height, as counted from the lower edge of the frame, which corresponds to the distance between the shoulder 8 and the upper edge surface of the side walls 3, encloses the outer peripheral line of the side walls from the upper edge of the side walls to the shoulder 8. As appears from FIG. 2, the shoulder 8 is thus located above the windows 7 and the distance a between the shoulder 8 and the upper edge of the side wall 3 of a load carrier is slightly less than the distance b between the lower edge of the windows 7 and the lower edge of the frame 4. This arrangement is preferred in order to prevent the windows 7 of one load carrier from becoming overlapped from the outside by a superjacent frame portion 4 and from the inside by a subjacent side wall portion 3 of sandwiching load carriers. However, a slight overlapping may be tolerated, but should not be of such an extent that it will impede adequate handling of the load carriers through said windows.

Preferably, the shoulder 8 in this embodiment has a width corresponding to the thickness of the frame walls 5, 5*a*, such that a stack of load carriers will have even lateral surfaces.

The fit between the side walls 3 of one load carrier and the frame 4 of another load carrier telescopically stacked thereon as described above may be a sliding fit or, as illustrated, a fit with a greater tolerance, in which case ribs 9 extending either inwardly from the lower portion of the inner surface of the frame or, as illustrated, from the outer surface of the side walls 3 on either side of the corners of the box member can be arranged for laterally supporting a superposed load carrier.

At the top of the inner surface of the frame 4, there are advantageously a plurality of circumferentially distributed elements 10 which project inwardly and, in the shown embodiment, are in the form of vertical ribs integrally moulded with the load carrier and bevelled at their lower ends. The ribs are provided by pairs on either side of the inner corner lines of the frame 4 and are adapted to laterally support rectangular objects L, such as square milk packages which are placed in the corners of a subjacent load carrier and extend up through and beyond the upper open end of this load carrier by a distance from the bottom 2 which exceeds the height of the frame. This lateral support enhances that capacity of these subjacent objects to stably support a superposed load which they have already been given by the relatively high frame 4. The inwardly facing surfaces of the ribs are contained in the same plane as the inner sides of the side walls 3 or slightly behind that plane, as illustrated, and the ribs 10 extend from the underside of the bottom 2 downwardly only over such a distance that they do not impede the abutment of the lower edge surface of the same load carrier on the shoulder 8 of a subjacent load carrier in the stack, when the latter is empty or carries objects $L_1$ of a lesser height than the frame height.

In the embodiment of FIG. 3 where the load carrier of the invention is of the square crate type, the frame 4' is similar to the frame 4 of the previous embodiment, such that the crate can be stacked on the platform-type load carrier shown in FIGS. 1 and 2. The sides of the crate which are designed with windows 7' have first shoulders 8' at the same distance from the upper edge of the crate as shoulder 8 in the previous embodiment, and the sides of the crate which are designed with the recesses 6' are provided on a lower level with second shoulders 8'' for abutting engagement with the lower edge surface of the sides, provided with windows, of a load carrier which is stacked after being turned 90° and which is being of the same type or of the type shown in e.g. FIGS. 1 and 2, this allowing a more compact stacking of for instance empty load carriers. Ridges 8''' vertically connected to the shoulders 8' are so located as to get clear of the side edges of the recesses 6'.

The now described embodiment with a square section is advantageous in so far as stacking of the load carriers can be made with four different orientations of each load carrier. However, as will be readily appreciated by anyone skilled in the art, this square configuration is not a compulsory feature of the present invention.

What I claim and desire to secure by Letters Patent is:

1. A nestable load carrier comprising an open-top box member with a bottom and side walls, for transporting and furnishing objects placed on said bottom, the carrier comprising also a frame connected to said bottom and having descending walls terminating in a lower edge surface which is substantially planar and continuous, with two similar opposed recesses in said descending walls, said recesses extending from said lower edge surface substantially up to said bottom and being dimensioned for insertion therein of at least one movable load-supporting member below said bottom, said frame also having two similar opposed windows in said descending walls spaced laterally from said recesses and dimensioned for insertion therein of at least one movable load-supporting member below said bottom, said descending walls defining an inner circumference of the frame which is greater than the outer circumference of said side walls, whereby the frame is adapted to telescopically receive the box member of an identical load carrier, and upwardly-facing first shoulder means located on the outer wall of the load carrier at a level no lower than the upper edges of said windows, said inner circumference exceeding said outer circumference at least through a height from said lower edge surface which corresponds to the distance from said first shoulder means to the upper edge of said side walls, said first shoulder means being operable to abut the lower edge surface of an identical superjacent load carrier into which said box member is telescopically received, said descending walls forming lateral retaining means for substantial embracing and holding together merchandise protruding into the frame and on which said bottom rests, said distance from the shoulder means to the upper edge of the side walls being no greater than the distance from the lower edges of said windows to said lower edge surface of the frame.

2. Load carrier as claimed in claim 1, characterized in that ribs (10) project from the inner surface of the frame to laterally support a load which protrudes sufficiently from the box member (1) of a subjacent load carrier in a stack.

3. Load carrier as claimed in claim 2, characterized in that said load carrier is rectangular, preferably square, said recesses (6) being disposed in two opposite sides (5) of the frame (4) and said windows (7) being disposed in the other two opposite sides **(5*a*)** of the frame.

4. Load carrier as claimed in claim 3, characterized in that said ribs (10) are provided adjacent and on either side of the inner corners of the frame (4), said ribs projecting at the most to the plane of the inner surface of the side wall (3) of the box member (1) and being bevelled at their lower ends.

5. Load carrier as claimed in claim 1, characterized in that said first shoulder means (8') is located on the sides of the load carrier which are provided with windows (7), and that second shoulder means (8'') is provided on the other two sides of the load carrier on a level below said first shoulder means (8') to serve as abutments for the free frame edge surface portions, located below the windows (7'), of another stacked load carrier, said first shoulder means (8') being so arranged as to permit being accomodated in the recesses (6'), thus ensuring a compact stacking of load carriers.

6. Load carrier as claimed in claim 1, characterized in that said load carrier is injection moulded as a single piece of plastic.

7. The load carrier of claim 1, in which the carrier is rectangular, said recesses being disposed in descending walls forming two opposite sides of the frame and said windows being disposed in descending walls forming the other two opposite sides of the frame, said four sides of the frame forming an unobstructed space defined by the descending walls, said descending walls forming four corners and including a wall partly defining said space and extending from each corner to a side edge of a said recess, the descending walls forming said lateral retaining means on all four sides of the frame.

8. The load carrier of claim 7, in which the two descending walls forming each said corner include ribs projecting from the inner surfaces of said two walls, said ribs being dimensioned and positioned to closely oppose a load of said merchandise which protrudes sufficiently from the box member of a subjacent load carrier to prevent said telescoping.

* * * * *